US008624831B2

(12) United States Patent
Kim et al.

(10) Patent No.: US 8,624,831 B2
(45) Date of Patent: Jan. 7, 2014

(54) ELECTROPHORETIC DISPLAY DEVICE AND METHOD OF DRIVING SAME

(75) Inventors: Joo-Young Kim, Suwon-si (KR); Cheol-Woo Park, Suwon-si (KR)

(73) Assignee: Samsung Display Co., Ltd., Yongin (KR)

( * ) Notice: Subject to any disclaimer, the term of this patent is extended or adjusted under 35 U.S.C. 154(b) by 1237 days.

(21) Appl. No.: 12/186,656

(22) Filed: Aug. 6, 2008

(65) Prior Publication Data

US 2009/0046052 A1 Feb. 19, 2009

(30) Foreign Application Priority Data

Aug. 14, 2007 (KR) ..... 10-2007-0081937

(51) Int. Cl.
*G09G 3/34* (2006.01)

(52) U.S. Cl.
USPC ..... 345/107; 359/296

(58) Field of Classification Search
USPC ..... 345/107
See application file for complete search history.

(56) References Cited

U.S. PATENT DOCUMENTS

| | | | | |
|---|---|---|---|---|
| 2005/0280626 | A1* | 12/2005 | Amundson et al. | 345/107 |
| 2006/0139309 | A1 | 6/2006 | Miyasaka | |
| 2007/0080927 | A1 | 4/2007 | Zhou et al. | |

FOREIGN PATENT DOCUMENTS

| | | |
|---|---|---|
| JP | 2005283820 | 10/2005 |
| JP | 2006189466 | 7/2006 |
| KR | 1020060076195 | 7/2006 |
| KR | 10-2006-0088114 | 8/2006 |
| KR | 10-2006-0088882 | 8/2006 |
| KR | 10-2006-0089722 | 8/2006 |
| KR | 1020060129191 | 12/2006 |
| KR | 1020070003987 | 1/2007 |

* cited by examiner

*Primary Examiner* — Abbas Abdulselam
*Assistant Examiner* — Shawna Stepp Jones
(74) *Attorney, Agent, or Firm* — H.C. Park & Associates, PLC

(57) ABSTRACT

An electrophoretic display ("EPD") device includes an EPD panel to display an image, and a driving circuit to drive the EPD panel. To display an individual image, the driving circuit supplies a first refresh signal to display a black gray scale, a second refresh signal to display a white gray scale, an inverse image data signal to display an inversed image of the individual image, an image data signal to display the individual image, and a reset signal to provide a direct current unbalance between the first and second refresh signals to the EPD panel.

11 Claims, 3 Drawing Sheets

ELECTROPHORETIC DISPLAY DEVICE AND METHOD OF DRIVING SAME

CROSS REFERENCE TO RELATED APPLICATION

This application claims priority from and the benefit of Korean Patent Application No. 10-2007-0081937, filed on Aug. 14, 2007, which is hereby incorporated by reference for all purposes as if fully set forth herein.

BACKGROUND OF INVENTION

1. Field of the Invention

The present invention relates to an electrophoretic display device, and more particularly, to an electrophoretic display device and a method of driving the same that may maintain paper-like image quality, when power is turned off, using an inverse afterimage.

2. Discussion of the Background

The importance of display devices to display information is on the rise. Display devices include a liquid crystal display ("LCD") device, an electrophoretic display ("EPD") device, and a plasma display panel ("PDP").

An EPD device may have a high reflection factor, a high contrast ratio, and a low visual angle reliance that allows viewers to feel as if they are viewing a sheet of paper. In addition, the EPD device may have a stable black or white state and may maintain images without the need for a continuous supply of voltage, thereby reducing power consumption. Further, unlike an LCD device, the EPD device may not require a polarizing plate, an alignment film, or liquid crystal and may have competitive manufacturing costs.

The EPD device may include a microcapsule having white and black charged particles reflecting external light or a microcup in a spacer shape. The EPD device may maintain a black or white image due to the stable characteristics of the black and white charged particles when power is turned off.

However, a conventional EPD device may show an undesirable grayish color after power is turned off.

SUMMARY OF INVENTION

The present invention provides an EPD device and a method of driving the same that may maintain paper-like image quality, even when power is cut off, using an inverse afterimage.

Additional features of the invention will be set forth in the description which follows, and in part will be apparent from the description, or may be learned by practice of the invention.

The present invention discloses an electrophoretic display device, including an electrophoretic display panel to display images and a driving circuit to drive the electrophoretic display panel. To display an individual image in a first signal supplying period, the driving circuit supplies a first refresh signal to display a black gray scale, a second refresh signal to display a white gray scale, an inverse image data signal to display an inversed image of the individual image, an image data signal to display the individual image, and a reset signal to provide a direct current unbalance between the first and second refresh signals to the electrophoretic display panel.

The present invention also discloses an electrophoretic display device, including an electrophoretic display panel to display images and a driving circuit to supply a first refresh signal and a second refresh signal that have opposite polarities, an inverse image data signal to display an inversed image of the individual image, and an image data signal to display the individual image to the electrophoretic display panel. A supplying time of the second refresh signal is shorter than a supplying time of the first refresh signal at a first signal supplying period, and the supplying time of the second refresh signal is identical to the supplying time of the first refresh signal in a second signal supplying period following the first signal supplying period.

The present invention also discloses a method of driving an electrophoretic display device, including supplying a first refresh signal, supplying a reset signal to provide a direct current unbalance, supplying a second refresh signal to compensate for the first refresh signal, supplying an inverse image data signal to display an inversed image of an individual image, and supplying an image data signal to display the individual image. The first refresh signal, the reset signal, the second refresh signal, the inverse image data signal, and the image data signal are supplied to the electrophoretic display panel for a signal supplying period to display the individual image on the electrophoretic display panel.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
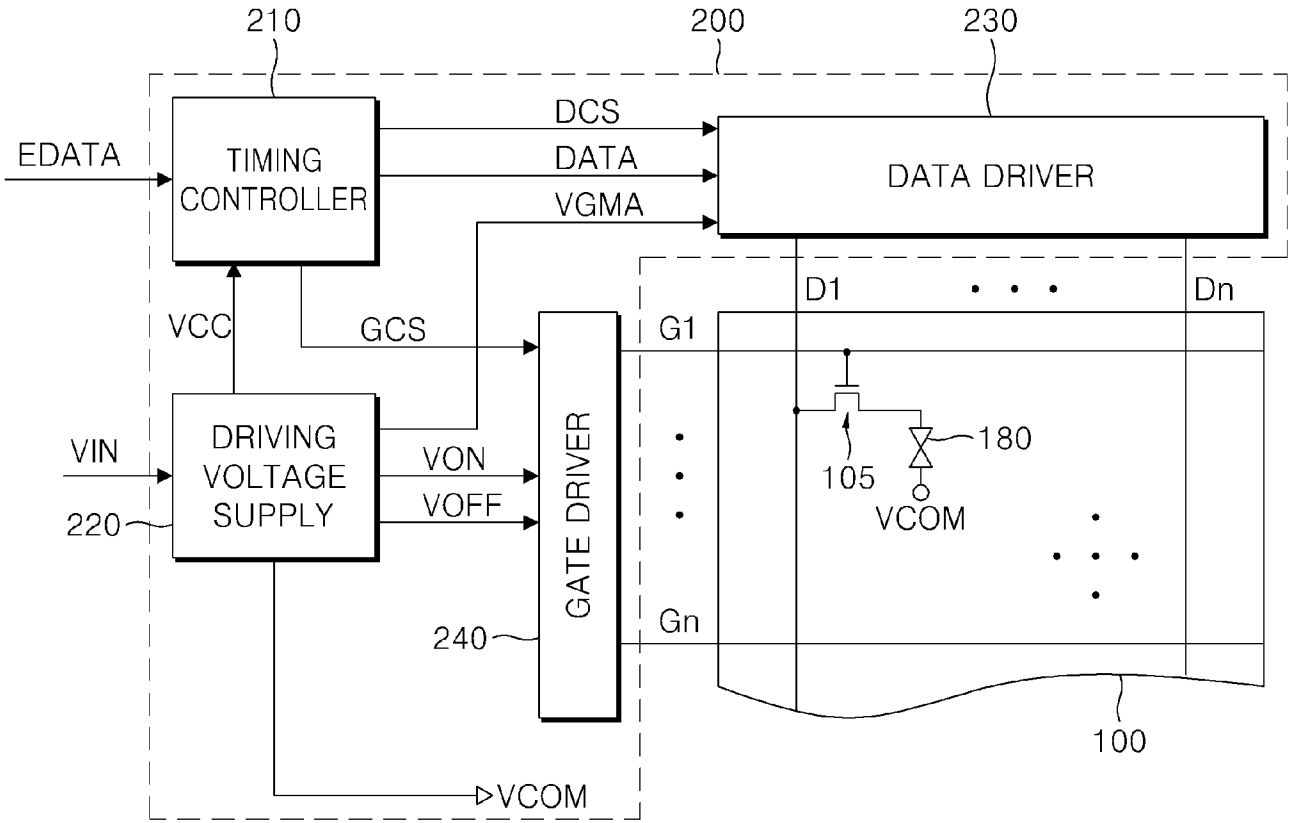
FIG. 1 is a block diagram of an electrophoretic display device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" or "connected to" another element, it can be directly on or directly connected to the other element or intervening elements may also be present. In contrast, when an element is referred to as being "directly on" or "directly connected to" another element, there are no intervening elements present.

An electrophoretic display ("EPD") device according to an exemplary embodiment of the present invention will be described with reference to FIG. 1, FIG. 2, FIG. 3, and FIG. 4.

The EPD device includes an EPD panel 100 and a driving circuit 200. The EPD panel 100 includes gate lines G1 to Gn, data lines D1 to Dn, thin film transistors ("TFT") 105, and electrophoretic elements 180. The TFTs 105 are connected to the gate lines GI to Gn and the data lines D1 to Dn and the electrophoretic elements 180 are connected to the TFTs 105.

The EPD panel 100 includes a TFT substrate 101, an electrophoretic element 180, and a protection substrate 190.

A gate electrode 111, a gate insulating layer 115, a semiconductor layer 121, an ohmic contact layer 123, a source electrode 131, a drain electrode 133, a passivation layer 141, and a pixel electrode 150 are arranged on the TFT substrate 101.

The gate electrode 111 is connected to the gate line G1. The gate insulating layer 115 may include an insulating material and is arranged on the gate electrode 111. The semiconductor layer 121 may include amorphous silicon and is arranged on the gate insulating layer 115, and the ohmic contact layer 123 may include doped amorphous silicon and is arranged on the semiconductor layer 121. The source and drain electrodes 131 and 133 are arranged on the ohmic contact layer 123 to oppose each other. The source and drain electrodes 131 and 133 are connected to each other through the semiconductor layer 121 and the ohmic contact layer 123. The passivation layer 141 may include an insulating material on the source and drain electrodes 131 and 133. The passivation layer 141 is arranged on the entire surface of the TFT substrate 101 and includes a contact hole 145 exposing a portion of the drain electrode 133. The pixel electrode 150 is arranged on the passivation layer 141 and connected to the drain electrode 133 via the contact hole 145. The pixel electrode 150 may include a transparent conductive layer or a reflective conductive layer.

The electrophoretic element 180 includes microcapsules 170, each having negative and positive pigment particles 171 and 173. For example, the negative pigment particles 171 are negatively charged and show a white color. The positive pigment particles 173 are positively charged and show a black color. The electrophoretic element 180 is adhered to an upper surface of the TFT substrate 101 by an adhesive 160.

A common electrode 195 and the protection substrate 190 are sequentially disposed on the electrophoretic element 180. The protection substrate 190 may include a smooth or flexible paper-like material. The common electrode 195 may include a transparent conductive material, for example, indium tin oxide (ITO), indium zinc oxide (IZO), at one side of the protective substrate 190.

The driving circuit 200 includes a timing controller 210, a driving voltage supply 220, a gate driver 240, and a data driver 230.

The timing controller 210 receives an externally input data signal EDATA and converts the externally input data signal EDATA into a data signal DATA that can be processed by the data driver 230. The data signal DATA is supplied to the data driver 230. The timing controller 210 generates a data control signal DCS to control the data driver 230 and a gate control signal GCS to control the gate driver 240 and then supplies the signals DCS and GCS to the data driver 230 and the gate driver 240, respectively. The data control signal DCS generated from the timing controller 210 may include a source start pulse, a source shift clock, etc. The gate control signal GCS generated from the timing controller 210 may include a gate start pulse, a gate shift clock, etc.

The driving voltage supply 220 receives an externally input voltage VIN and converts the input voltage VIN into voltages to drive the timing controller 210, the data driver 230, and the gate driver 240. The voltages include a driving voltage VCC, a gamma voltage VGMA, and a gate-on voltage VON, and a gate-off voltage VOFF. The driving voltage supply 220 supplies the driving voltage VCC to the timing controller 210, the gamma voltage VGMA to the data driver 230, and the gate-on and gate-off voltages VON and VOFF to the gate driver 240.

The data driver 230 receives the data control signal DCS, the data signal DATA, and the gamma voltage VGMA to display a gray scale of the data signal DATA. The data driver 230 supplies data signals to the data lines D1 to Dn according to the signals DCS and DATA and the voltage VGMA.

When the data driver 230 displays an image through the electrophoretic element 180, the data driver 230 supplies a positive level voltage, a negative level voltage, and a ground level voltage in response to the data control signal DCS to the data lines D1 to Dn. For example, the data driver 230 supplies +15V, −15V, and ground level voltages to the data lines D1 to Dn to move the negative and positive pigment particles 171 and 173 of the electrophoretic element 180.

The gate driver 240 receives the gate control signal GCS from the timing controller 210 and receives the gate-on and gate-off voltages VON and VOFF from the data driver 220. The gate driver 240 sequentially supplies the gate-on voltage VON to the gate lines G1 to Gn and supplies the gate-off voltage VOFF to the remaining gate lines to which the gate-on voltage VON is not supplied. The gate driver 240 sequentially turns on the TFTs 105 of each gate line G1 to Gn.

Figure 2:
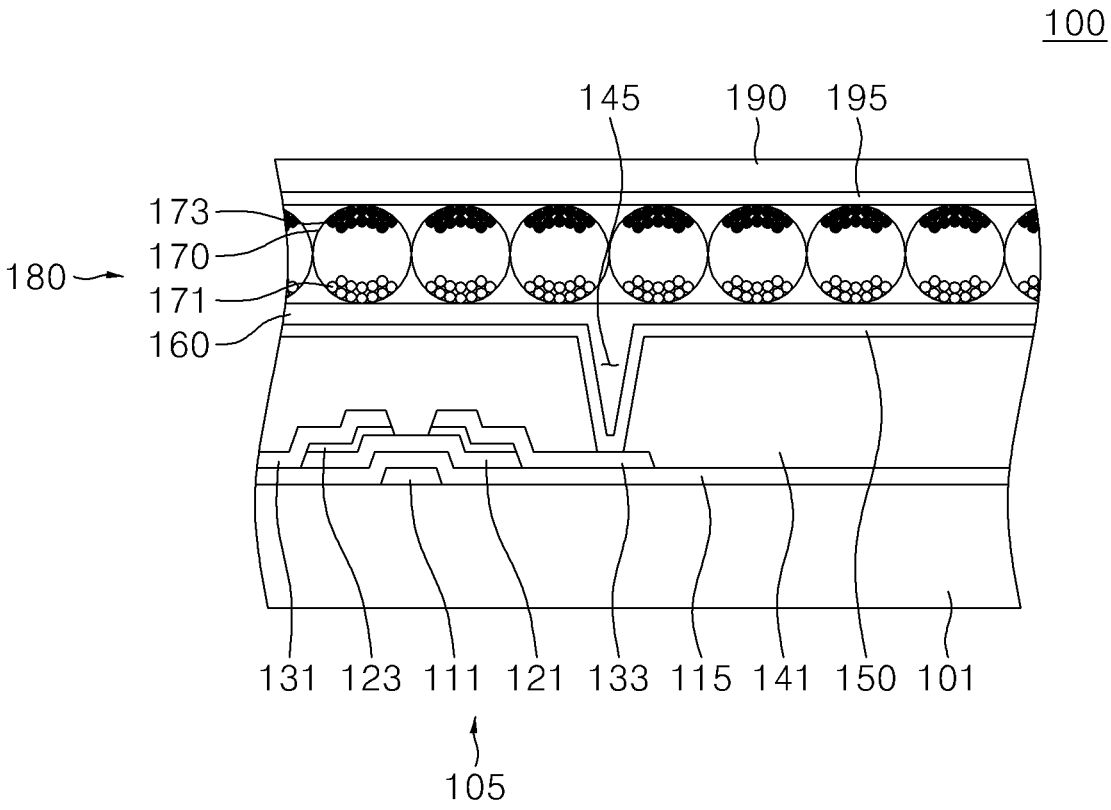
FIG. 2 is a cross-sectional view showing an electrophoretic display panel in FIG. 1.

The driving circuit 200 of the EPD device is described in detail below with reference to FIG. 1, FIG. 2, and FIG. 3.

The driving circuit 200 supplies a first refresh signal 310, a second refresh signal 330, an inverse image data signal 340, an image data signal 350, a reset signal 320, and a reset compensation signal 325 to the EPD panel 100 for a signal supplying period to display an individual image.

The first refresh signal 310 is a positive signal to display a black color on the EPD panel 100. For example, the first refresh signal 310 causes a voltage of +15V to be supplied to the data lines D1 to Dn to display a black gray scale on the EPD panel 100.

The second refresh signal 330 is a negative signal to display a white color on the EPD panel 100. For example, the second refresh signal 330 causes a voltage of −15V to be supplied to the data lines D1 to Dn to display a white gray scale on the EPD panel 100.

A supplying time Tb of the first refresh signal 310 is identical to a supplying time Tw of the second refresh signal 330 to maintain a direct current ("DC") balance for the same signal supplying period.

The DC balance prevents a variation in the quantity of electric charges of the electrophoretic element 180 by balancing the polarities of signals supplied to the EPD panel. However, when the DC balance is not compensated for, an inverse afterimage corresponding thereto may be generated. For example, when a white gray scale signal is not compensated for in an EPD panel to which the black gray scale signal is supplied, an afterimage of the white gray scale may occur.

The first refresh signal 310 and the second refresh signal 330 are not limited to the positive signal and the negative signal, respectively but may have opposite polarities according to a driving method of the driving circuit.

The inverse image data signal 340 inversely displays white and black gray scales of an individual image to be displayed. For example, the inverse image data signal 340 causes a white gray scale and a black gray scale displayed by the image data signal 350 to change to a black gray scale and a white gray scale, respectively. As the result, the inverse image data signal 340 preliminarily compensates for a DC balance with the image data signal 350.

The data signal 350 includes data to display an image.

The reset signal 320 provides a DC unbalance in refresh driving. The DC balance equally adjusts positive and negative voltage levels according to black and white gray scales per pixel area. After the first refresh signal 310 is generated for the first signal supplying period, the reset signal 320 is output at the start portion of the second refresh signal 330 to display a black gray scale like together with the first refresh signal 310. The reset signal 320 generates an inverse afterimage of the electrophoretic element by providing a DC unbalance for an image data maintaining period T1 during which a driving voltage is not supplied. For example, the reset signal 320 of the black gray scale gradually generates an inverse afterimage after a power is cut off at a white gray scale of a displayed image, thereby showing the white gray scale. As a result, the reset signal 320 may maintain the white gray scale of the image for a longer time.

A supplying time of the reset signal 320 may correspond to about 6% to about 7% of the supplying time Tb of the first refresh signal 310. Likewise, the supplying time of the reset signal 320 may correspond to about 6% to about 7% of the supplying time Tw of the second refresh signal 330. When the supplying time of the reset signal 320 is shorter than 6% of the supplying time Tb or Tw, it may be difficult to maintain a white gray scale corresponding to an inverse image. When the supplying time of the reset signal 320 is more than 7% of the supplying time Tb or Tw, it may be possible to generate an inverse afterimage but the driving efficiency of the EPD device may be reduced due to an increase in the refresh driving time.

For the image data maintaining period T1, an image displayed by the previous image data signal 350 is continuously displayed. The image data maintaining period T1 is generated due to physical characteristics of the electrophoretic element 180 and an image may be displayed for the image data maintaining period T1 even after a driving voltage is cut off.

After the image data maintaining period T1, the first refresh signal 310, the reset signal 320, the reset compensation signal 325, the second refresh signal 330, the inverse image data signal 340, and the image data signal 350 are sequentially output for the next signal supplying period to display the next individual image. The driving circuit 200 further outputs the reset compensation signal 325 to display a white gray scale to compensate for the DC unbalance.

The reset compensation signal 325 is output to compensate for the reset signal 320 supplied for the previous signal supplying period when two or more individual images are displayed. The reset compensation signal 325 displays the white gray scale to compensate for the black gray scale displayed by the reset signal 320. The reset compensation signal 325 may be output immediately after the reset signal 320.

The reset compensation signal 325 may be output for a time corresponding to about 6% to about 7% of the supplying time Tb or Tw of the first refresh signal 310 or the second refresh signal 330. The supplying time of the reset compensation signal 325 may be identical to the supplying time of the reset signal 320.

The reset signal 320 output for the second signal supplying period is compensated for by a reset compensation signal (not shown) output for a third signal supplying period. That is, although the reset compensation signal 325 is not output for the first signal supplying period, the reset compensation signal 325 output for the next signal supplying period compensates for the reset signal 320 output for the previous signal supplying period.

During the last signal supplying period, the driving circuit 200 sequentially outputs signals to display a last individual image and compensates for the DC balance of the reset signal 320 of the previous signal supplying period. For example, the driving circuit 200 sequentially outputs the first refresh signal 310, the reset compensation signal 325, the second refresh signal 330, the inverse image data signal 340, and the image data signal 350.

Figure 4:
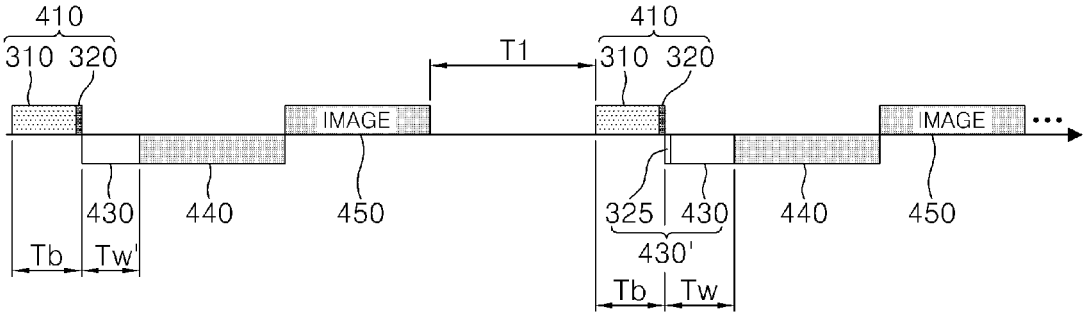
FIG. 4 is a diagram showing output signals of a driving circuit according to another exemplary embodiment of the present invention.

FIG. 4 is a diagram showing output signals of a driving circuit according to another exemplary embodiment of the present invention.

The driving circuit 200 outputs a first refresh signal 410, a second refresh signal 430, an inverse image data signal 440, and an image data signal 450 for a signal supplying period to display an individual image.

The first refresh signal 410 is a positive signal to display a black color on the EPD panel 100. In comparison with the first refresh signal 310 in FIG. 3, the first refresh signal 410 is output for a time during which the first refresh signal 310 and the reset signal 320 are output. The first refresh signal 410 may include the first refresh signal 310 and the reset signal 320.

The second refresh signal 430 is a negative signal to display a white color on the EPD panel 100. During the first signal supplying period, a supplying time Tw' of the second refresh signal 430 is shorter than a supplying time Tb of the first refresh signal 410. For example, the supplying time Tw' of the second refresh signal 430 may correspond to a time subtracting a supplying time of the reset signal 320 in FIG. 3 from the supplying time Tb of the first refresh signal 430.

Especially, the supplying time Tw' of the second refresh signal 430 may be shorter than the supplying time Tb of the first refresh signal 410 by about 6% to about 7% of the supplying time Tb. Therefore, the second refresh signal 430 provides a DC unbalance. Then the driving circuit 200 leads to an inverse afterimage of the first refresh signal 410 and increases a white gray scale maintaining time, thereby shortening the driving time of the driving circuit.

When the supplying time Tw' of the second refresh signal 430 is less than 6% of the supplying time Tb of the first refresh signal 410, it may be difficult to obtain an inverse afterimage effect. When the supplying time Tw' is more than 7% of the supplying time Tb, it may be difficult to obtain the refresh driving effect.

After the first signal supplying period, a supplying time Tw of the second refresh signal 430' is identical to the supplying time Tb of the first refresh signal 410 to compensate for the DC unbalance generated for the previous signal supplying period. A second refresh signal 430' is output for the supplying time Tw' of the second refresh signal 430 generated for the previous signal supplying period and the supplying time of the reset compensation signal 325 in FIG. 3. The second refresh signal 430' includes the second refresh signal 430 and the reset compensation signal 325.

The first refresh signal 410 and the second refresh signal 430 are not limited to a positive polarity signal and a negative polarity signal, respectively and the opposite polarity signals may be applied.

Figure 3:
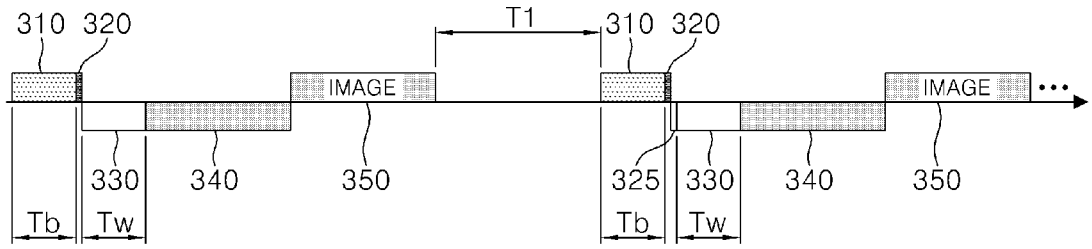
FIG. 3 is a diagram showing output signals of a driving circuit in FIG. 1.

The inverse data image signal 440, the data image signal 450, and the image data maintaining period T1 in FIG. 4 have the same configuration as corresponding ones in FIG. 3, and therefore a detailed description thereof is omitted.

During the last signal supplying period to display the last individual image, a supplying time of the first refresh signal 410 may be shorter than the supplying time of the first refresh signal 410 generated for the previous signal supplying period. For example, the driving circuit 200 sequentially outputs the first refresh signal 410, the second refresh signal 430', the inverse image data signal 440, and the image data signal 450.

The supplying time of the first refresh signal 410 generated for the last signal supplying period may be about 6% to about 7% shorter than the supplying time of the first refresh signal 410 generated for the pervious signal supplying period. Therefore, the driving circuit 200 may display the last individual image and adjust the whole DC balance.

A method of driving an EPD device is described in detail below with reference to FIG. 3.

During the first signal supplying period to display an individual image, the first refresh signal 310, the reset signal 320, the second refresh signal 330, the inverse image data signal 340, and the image data signal 350 are supplied to the EPD panel.

The first refresh signal 310 has a positive voltage to display a black color on the EPD panel 100. For example, the driving circuit 200 supplies the positive voltage to a pixel electrode of the EPD panel 100 for a period of time to display a black color. Then positive pigment particles of an EPD element move toward a common electrode and reflect external light to display the black color.

The reset signal 320 has a positive voltage to display a black color on the EPD panel 100. A supplying time of the reset signal 320 corresponds to about 6% to about 7% of a supplying time of the first refresh signal 310. The reset signal 320 generates a DC unbalance so that an inverse afterimage that gradually shows a white gray scale may be induced. The compensation for the reset signal 320 generating the DC unbalance is implemented when the next individual image is displayed, which will be described below.

The second refresh signal 330 has a negative voltage to compensate for the DC balance caused by the first refresh signal 310 and displays a white color on the EPD panel 100. A supplying time of the second refresh signal 330 is identical to a supplying time of the first refresh signal 310. The inverse image data signal 340 displays an inversed image of an individual image. For example, the inverse image data signal 340 changes a white gray scale and a black gray scale of the individual image into a black gray scale and a white gray scale, respectively. The inverse image data signal 340 is supplied prior to the image data signal 350 to preliminarily compensate for the DC balance for the image data signal 350.

The image data signal 350 causes the EPD panel 100 to display the individual image according to a voltage and a signal supplying time.

As described above, the individual image is displayed during the first signal supplying period by sequentially supplying the first refresh signal 310, the reset signal 320, the second refresh signal 330, the inverse image data signal 340, and the image data signal 350 to the EPD panel 100. Thereafter, the individual image is continuously maintained until the next signal supplying period to display the next individual image is started without providing an additional driving signal. Due to characteristics of the EPD element, the EPD panel may continue to display the individual image until the next driving signal is supplied even though a driving voltage is not supplied.

Next, the first refresh signal 310, the reset signal 320, the reset compensation signal 325, the second refresh signal 330, the inverse image data signal 340, and the image data signal 350 are supplied to the EPD panel for the second signal supplying period to display the next individual image.

The refresh signal 310 displaying a black gray scale is supplied to the EPD panel 100 to remove an afterimage and an electric charge of the previous individual image. The reset signal 320 displaying a black gray scale provides a DC unbalance and induces an inverse afterimage. The reset compensation signal 325 displaying a white gray scale compensates for the DC unbalance provided by the reset signal 320 for the previous signal supplying period. A supplying time of the reset compensation signal 325 is identical to a supplying time of the reset signal 320 provided for the previous signal supplying period. That is, the DC unbalance generated at the first signal supplying period is compensated for at the second signal supplying period. Likewise, the DC unbalance generated by the reset signal 320 at the second signal supplying period is compensated for by the reset compensation signal 325 at the third signal supplying period.

The second refresh signal 330 compensates for the DC balance caused by the first refresh signal 310. The inverse image data signal 340 displays the inversed image of the second individual image. The image data signal 350 displays the second individual image.

The EPD device according to exemplary embodiments of the present invention outputs the reset signal generating an inverse afterimage by providing a DC unbalance together with the refresh signals. Therefore, even though a driving voltage is cut off after an image is displayed, a grayish phenomenon may be prevented by an inverse afterimage, thereby obtaining paper-like picture quality.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An electrophoretic display device, comprising:

an electrophoretic display panel to display images; and a driving circuit to drive the electrophoretic display panel, wherein to display an individual image in a first signal supplying period, the driving circuit supplies a first refresh signal to display a black gray scale, a second refresh signal to display a white gray scale, an inverse image data signal to display an inversed image of the individual image, an image data signal to display the individual image, and a reset signal to provide a direct current unbalance to the electrophoretic display panel while the individual image is displayed, the reset signal being supplied between the first refresh signal and the second refresh signal.

2. The electrophoretic display device of claim 1, wherein the reset signal displays the black gray scale.

3. The electrophoretic display device of claim 1, wherein the driving circuit further supplies a reset compensation signal to the electrophoretic display panel in a second signal supplying period to compensate for the reset signal supplied in the first signal supplying period.

4. The electrophoretic display device of claim 3, wherein the reset compensation signal displays a white gray scale.

5. The electrophoretic display device of claim 3, wherein a supplying time of the reset compensation signal is identical to a supplying time of the reset signal.

6. The electrophoretic display device of claim 1, wherein the first refresh signal and the second refresh signal are supplied for the same length of time.

7. The electrophoretic display device of claim 1, wherein the reset signal is supplied for the same duration in each signal supplying period.

8. The electrophoretic display device of claim 7, wherein the reset signal is supplied for a time corresponding to about 6% to about 7% of a supplying time of the first refresh signal.

9. The electrophoretic display device of claim 1, wherein the electrophoretic display panel comprises a thin film transistor substrate on which gate lines and data lines are arranged and an electrophoretic element to display an image by reflecting light at an upper surface of the thin film transistor substrate.

10. The electrophoretic display device of claim 9, wherein the electrophoretic element comprises a microcapsule having particles that are negatively charged and positively charged and display a white gray scale and a black gray scale.

11. The electrophoretic display device of claim 10, wherein the driving circuit comprises a gate driver to drive the gate lines, a data driver to drive the data lines, a timing controller to supply a data signal and a control signal to the data driver, and a driving voltage supply to supply a driving voltage.

* * * * *